US009802075B2

(12) United States Patent
Gvoich

(10) Patent No.: US 9,802,075 B2
(45) Date of Patent: Oct. 31, 2017

(54) DUAL BALANCE EXERCISE APPARATUS

(71) Applicant: GVOICH FITNESS SYSTEMS, Baton Rouge, LA (US)

(72) Inventor: William Gvoich, Baton Rouge, LA (US)

( * ) Notice: Subject to any disclaimer, the term of this patent is extended or adjusted under 35 U.S.C. 154(b) by 0 days.

(21) Appl. No.: 15/099,817

(22) Filed: Apr. 15, 2016

(65) Prior Publication Data

US 2016/0250514 A1 Sep. 1, 2016

Related U.S. Application Data

(63) Continuation-in-part of application No. 13/887,034, filed on May 3, 2013, now Pat. No. 9,314,659.

(51) Int. Cl.

| | |
|---|---|
| ***A63B 21/062*** | (2006.01) |
| ***A63B 21/00*** | (2006.01) |
| ***A63B 23/035*** | (2006.01) |
| *A63B 22/02* | (2006.01) |
| *A63B 22/00* | (2006.01) |
| *A63B 22/06* | (2006.01) |
| *A63B 71/06* | (2006.01) |
| *A63B 21/005* | (2006.01) |

(Continued)

(52) U.S. Cl.

CPC ..... *A63B 21/4035* (2015.10); *A63B 21/0628* (2015.10); *A63B 21/154* (2013.01); *A63B 21/4043* (2015.10); *A63B 23/03541* (2013.01); *A63B 71/0622* (2013.01); *A63B 21/005* (2013.01); *A63B 21/008* (2013.01); *A63B 21/068* (2013.01); *A63B 21/156* (2013.01); *A63B 22/0076* (2013.01); *A63B 22/02* (2013.01); *A63B 22/0605* (2013.01); *A63B 22/0664* (2013.01); *A63B 2071/0625* (2013.01); *A63B 2071/0627* (2013.01); *A63B 2071/0652* (2013.01); *A63B 2071/0655* (2013.01); *A63B 2213/00* (2013.01); *A63B 2220/51* (2013.01); *A63B 2225/50* (2013.01)

(58) Field of Classification Search

CPC ..... A63B 21/4035; A63B 21/4043; A63B 21/154; A63B 21/156; A63B 21/0628; A63B 21/068; A63B 23/03541; A63B 71/0622; A63B 2071/0655; A63B 2071/0627; A63B 2071/0652; A63B 2213/00; A63B 22/0664; A63B 22/0605; A63B 22/0076; A63B 22/02

See application file for complete search history.

(56) References Cited

U.S. PATENT DOCUMENTS 6,394,935 B1 * 5/2002 Lake ..... A63B 21/154 482/93
6,458,061 B2 * 10/2002 Simonson ..... A63B 21/0628 482/102

(Continued)

*Primary Examiner* — Loan H Thanh
*Assistant Examiner* — Megan Anderson
(74) *Attorney, Agent, or Firm* — Ted M. Anthony

(57) ABSTRACT

A weight resistance exercise machine having cable and pulley linkage assemblies attached to a single weight stack. Each cable and pulley linkage assembly, which is independent of the other(s), can be used by one arm or leg during bilateral exercise training (that is, training in which both limbs of a pair are used to simultaneously to lift a weight). A tilt platform and biofeedback assembly display and measure in real-time how much each limb of a pair is contributing to such lifting effort.

14 Claims, 7 Drawing Sheets

(51) Int. Cl.
*A63B 21/008* (2006.01)
*A63B 21/068* (2006.01)

(56) References Cited

U.S. PATENT DOCUMENTS

| | | | | |
|---|---|---|---|---|
| 7,169,093 | B2 * | 1/2007 | Simonson | A63B 21/152<br>482/103 |
| 8,016,730 | B2 * | 9/2011 | Alessandri | A63B 21/154<br>482/116 |
| 8,475,346 | B2 * | 7/2013 | Gerschefske | A63B 21/023<br>482/129 |
| 8,827,877 | B2 * | 9/2014 | Giannelli | A63B 21/062<br>482/102 |
| 2013/0274075 | A1 * | 10/2013 | Habing | A63B 21/062<br>482/102 |

* cited by examiner

DUAL BALANCE EXERCISE APPARATUS

CROSS REFERENCES TO RELATED APPLICATION

This application is a continuation-in-part of application Ser. No. 13/887,034, filed May 3, 2013, incorporated herein by reference, currently pending.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to weight resistance exercise machines. More particularly, the present invention pertains to an exercise assembly having a multi-cable and pulley linkage system attached to a single load such as a weight stack, or other resistance means (including, without limitation, pneumatic, hydraulic or electromagnetic) and attached to a biofeedback system.

2. Brief Description of the Prior Art

It is well established that many people have some level of imbalanced strength in their limbs. In other words, limbs on one side of a person's body are usually stronger than limbs on the other side of the body. This common phenomenon frequently results in a person's body being divided into a dominant (strong) side and a non-dominant (weak) side of the body.

Such imbalanced strength can result in a condition known as "bilateral deficit." As used herein, the term "bilateral deficit" refers to a condition in which the total force produced by two limbs (for example, left and right arms) is less than the sum of the forces produced by such limbs acting alone. By contrast, the term "bilateral facilitation" is when the total force produced by both left and right limbs is greater than the sum of the forces produced by such limbs acting alone.

When a person uses only one limb to perform a physical task (for example, lifting a weight, or throwing or kicking a ball), the person typically uses his or her dominant side, because the dominant side is stronger, more efficient and feels more natural to use. When a person performs a physical task using both limbs (such as, for example, lifting a weight or an object using both arms simultaneously), the person typically tends to lead and lift more with limb(s) on the dominant side of the body; hence the expressions—"right side dominant" or "left side dominant".

Conventional exercise machines do not take such imbalance into account. Such conventional exercise machines typically have a support frame and a load (frequently comprising a weight stack or some other resistance means) mounted on or near said frame. A linkage system, usually comprising a cable and pulley system or movement arms, enable a user to lift said load when performing specific resistance exercise movements. In many cases, such exercise machines can be used for bilateral exercise—that is, exercise in which both limbs (arms or legs) are used simultaneously. However, cable and pulley linkage systems of conventional exercise machines do not allow for a determination of how much each limb (whether arm or leg) is contributing to the overall effort when weight is lifted during bilateral exercise performance.

Moreover, with conventional resistance exercise machines, weight is typically lifted in a predetermined, linear fashion using guide rods or movement arms that create a fixed exercise motion. There is no balance involved during this type of exercise. Such fixed motion frequently produces "linear strength" as dictated by the machine. However, the human body generally does not function in a purely linear manner during normal physical activity. Muscles do not work in isolation, but rather in an integrated and balanced team effort.

Conventional linear guided exercise machines, which provide for fixed motion during exercise performance, limit the development of balanced strength. No internal correction is needed to perform the movements and virtually no external feedback is given to a user with regard to symmetry of force production. Lifting a weight that requires a user to balance both sides during bilateral exercise improves balanced strength and thereby delivers better training results.

Such muscular imbalance, which is not addressed by conventional exercise equipment, is an important factor to consider for injury prevention, physical performance and/or for therapy used to recover from an existing injury. Conventional exercise equipment manufacturers have attempted to even out this muscle imbalance by adding a second load or weight stack into the equipment design—that is, one weight stack for each limb. This concept is frequently referred to as "unilateral training." However, this solution does not address the fundamental issue of balanced bilateral training.

Another limitation of conventional exercise equipment is the lack of biofeedback. By using biofeedback information, a user's brain quickly learns how to control sensory-understandable interpretations, and this biofeedback loop trains the muscles involved to adapt to the training stimuli. The result is a self-regulatory process. As such, biofeedback can be an essential tool in exercise performance when enhanced body-mind link is promoted. Importantly, biofeedback training can also train a user's nervous system to "lead with the weak side" during bilateral exercise performance.

Thus, there is a need for a new and improved exercise assembly system for resistance-based training. Such exercise assembly should be simple in design and cost effective, while suitable for use in the prevention and rehabilitation of muscle and joint injuries. Further, such exercise equipment should help correct bilateral deficit during bilateral exercise performance; specifically, such exercise equipment should help correct muscle/strength imbalance between dominant and non-dominant limbs (arms or legs) during exercise (work) performance. Such exercise equipment should beneficially improve functional strength, while training a user's non-dominant limb(s) to become more efficient in contributing to work effort during bilateral exercise performance in order to make the contribution of effort more even between the two limbs.

Such exercise assembly should also beneficially provide biofeedback information that clearly indicates how much each limb is contributing to an overall work effort during bilateral exercise performance. Such biofeedback should train a user's neuromuscular system to contribute equally with both sides of the body during exercise performance and train a user's brain and nervous system to "lead with the weak side" during bilateral exercise performance.

Exercise speed, or speed of movement, is another important consideration in exercise equipment design. The load being lifted (as expressed in pounds, for example) represents a true weight while said load is at rest or when moving at a constant speed. However, once the load is in motion, the changes in speed movement can cause the actual weight resistance to change. This is especially noticeable during high speed training. These changes in force are affected by acceleration and/or deceleration of a load when the speed of movement changes. Thus, there is a need for a pulley system designed specifically for high speed training, by adding one or more additional wheels to the cable pulley configuration.

SUMMARY OF THE INVENTION

The exercise assembly of the present invention introduces dynamic balance into the exercise process in order to correct muscle imbalance and bilateral deficit, and to promote bilateral facilitation. A user of the exercise assembly of the present invention will immediately see when weight is being lifted in an unbalanced manner, such as when there is an imbalance in the effort exerted between two sides of a user's body during bilateral exercise. As a result, a user of the present invention must dynamically shift and change effort in order to achieve balance during exercise. A user's neuromuscular system responds better when a user is required to recover and correct for a shift in weight imbalance during exercise performance.

Kinesthesia is a person's "muscle sense"—the sensation by which bodily position, weight, muscle tension and movement are perceived by that person. With "linear" resistance training, a user's kinesthetic system is not challenged in a holistic manner; as a result, a user has no external mechanism to correct weight imbalance and is unable to correct muscle asymmetry and bilateral deficit. However, by stimulating both sides of a user's body during exercise and dynamically activating balancing mechanisms that require a user to coordinate both sides of the body, integrated benefits to a user during exercise will be significantly greater.

The dual balance exercise assembly of the present invention activates both a user's kinesthetic system (muscles and tendons) and proprioceptors (sensory receptors that detect motion or body position). As a result, dominant-side forces are reduced, while weak-side forces are increased, in order to create a balanced effort during bilateral exercise performance. In this manner, a user's nervous system learns to dynamically adjust in order to achieve balanced effort and coordinated strength.

In the preferred embodiment, the present invention comprises a bilateral exercise machine having a frame, a weight stack (load) and dual cable and pulley linkage assemblies attached to said weight stack. Said cable and pulley linkage assemblies are independent of one another; that is, such cable and pulley linkage systems are oriented in a manner that splits loading from the weight stack into two equal halves, with fifty (50%) percent resistance for each limb during bilateral exercise performance. In the preferred embodiment, even though said dual cable and pulley linkage assemblies are separate and independent from each other, such parallel linkage assemblies are attached to the same weight stack (and not multiple weight stacks).

Because such cable and pulley linkage assemblies of the present invention operate independently from each other, a user immediately receives an indication if one limb (arm or leg) is contributing more effort than the other limb during bilateral exercise. Such indication includes, without limitation, a cable on the "weaker" side becoming slack which, in turn, results in a weight being off-balance and a user seeing that the weight being lifted is off-balance.

In a preferred embodiment, the exercise assembly of the present invention comprises a tilt platform that enables a user to receive "real-time" visual feedback during exercise performance. Such tilt platform further stimulates both sides (limbs) of a user's body during exercise and dynamically activates balancing mechanisms that require a user to coordinate both sides of the body in order to balance the weight that is being lifted.

Said tilt platform is more responsive and sensitive to the uneven contribution of each limb to force exertion during bilateral exercise. Due to its sensitivity, the tilt platform provides the user "real-time" biofeedback via force output and constantly challenges the user to keep the platform from tilting. Ultimately, the goal is to keep the platform in a horizontally level position (i.e., parallel to the top plate of the weight stack) during bilateral exercise performance. Additionally, by utilizing said tilt platform, the integrated benefits to a user during exercise performance will be substantially greater by way of challenging a user's kinesthetic system.

Even though the weight stack is "guided" in a linear manner with guide rods, the tilt platform is dynamic, thus constantly giving feedback to the user via force output and challenging said user to make any necessary adjustments in order to keep said tilt platform in a relatively horizontal position. As a result, the tilt platform requires balance and an increased mind-body connection, as well as an improved neuro-muscular function. By focusing on keeping the tilt platform in a relatively horizontal position (i.e., parallel to the top plate of the weight stack), the user (1) has "real-time" visual feedback due to the sensitivity and response of said tilt platform; and (2) is forced to make any necessary adjustments, and as a result, can engage the mind to focus on controlling the speed of the exercise movement, thereby enabling the nervous system to develop a better muscle/strength balance.

Thus, the tilt platform allows a user to visually see which limb is contributing more or less output, or effort, during bilateral training. For example, if the left limb is exerting more force, the left side of the tilt platform will lift in a relatively upward direction and the right side of the tilt platform will drop or tilt in a relatively downward direction, thereby indicating that the right limb is not contributing as much effort as the left limb. By constantly adjusting the force that is exerted by the limbs during exercise performance to make them equal, the user will be able to train the brain and nervous system and to train the muscles to perform equally, thereby correcting strength imbalance between two limbs.

Through visual feedback, a user can now turn strength "imbalance" between two limbs into "balance" by way of lifting with both limbs relatively equally during exercise performance. The user will be able to learn not to lead with a dominant side, but rather to use both limbs equally and evenly during bilateral training. As a result, when there is a dual balance between the two limbs, which is represented by two independent (separate) cables working together during bilateral exercise, there is no longer a force output or tension imbalance due to strength imbalance.

In an alternate embodiment, the exercise assembly of the present invention comprises an electronic biofeedback system that enables a user to receive visual feedback during exercise performance. Such electronic biofeedback system provides further information to a user to indicate how much each limb is contributing to the overall work effort during bilateral exercise.

Said electronic biofeedback system may beneficially comprise a force gauge or a load cell, attached to a pressure point on a cable upon which the weight being lifted is exerting a force or pressure. In the preferred embodiment, such measured force is relayed to a digital display that displays the amount of weight being lifted by each individual limb during bilateral exercise. Such electronic biofeedback system of the present invention can help a user to "even out" bilateral deficit effects, and train a user to "lead with the weak side" in order to build strength in said weak side.

In another of its aspects, the exercise assembly of the present invention comprises a weight stack and/or associated housing allowing for attachment of at least one pulley wheel(s) to the present pulley configuration. During high speed training, such pulley system enables a user to perform high speed movements without "throwing" the weight ahead. Put another way, the resistance provided by such pulley system serves to decelerate weight being lifted due to its "dampening" effect during high speed weight training.

The dual balance exercise assembly of the present invention permits a user to work both sides of the body in a coordinated, dynamic manner using bilateral strength or resistance training. In addition to other benefits, such balanced training and said tilt platform can also significantly improve physical therapy outcomes and training outcomes. By challenging a user's nervous system, muscles and connective tissues work together to achieve balanced effort. As a result, the electronic biofeedback system complements the tilt platform and the dual cable system by providing additional feedback, neural stimulation, and a greater neural adaptation. Thus, a user's body is able to learn how to strengthen the weaker side of the body by integrating and strengthening the mind-body connection.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
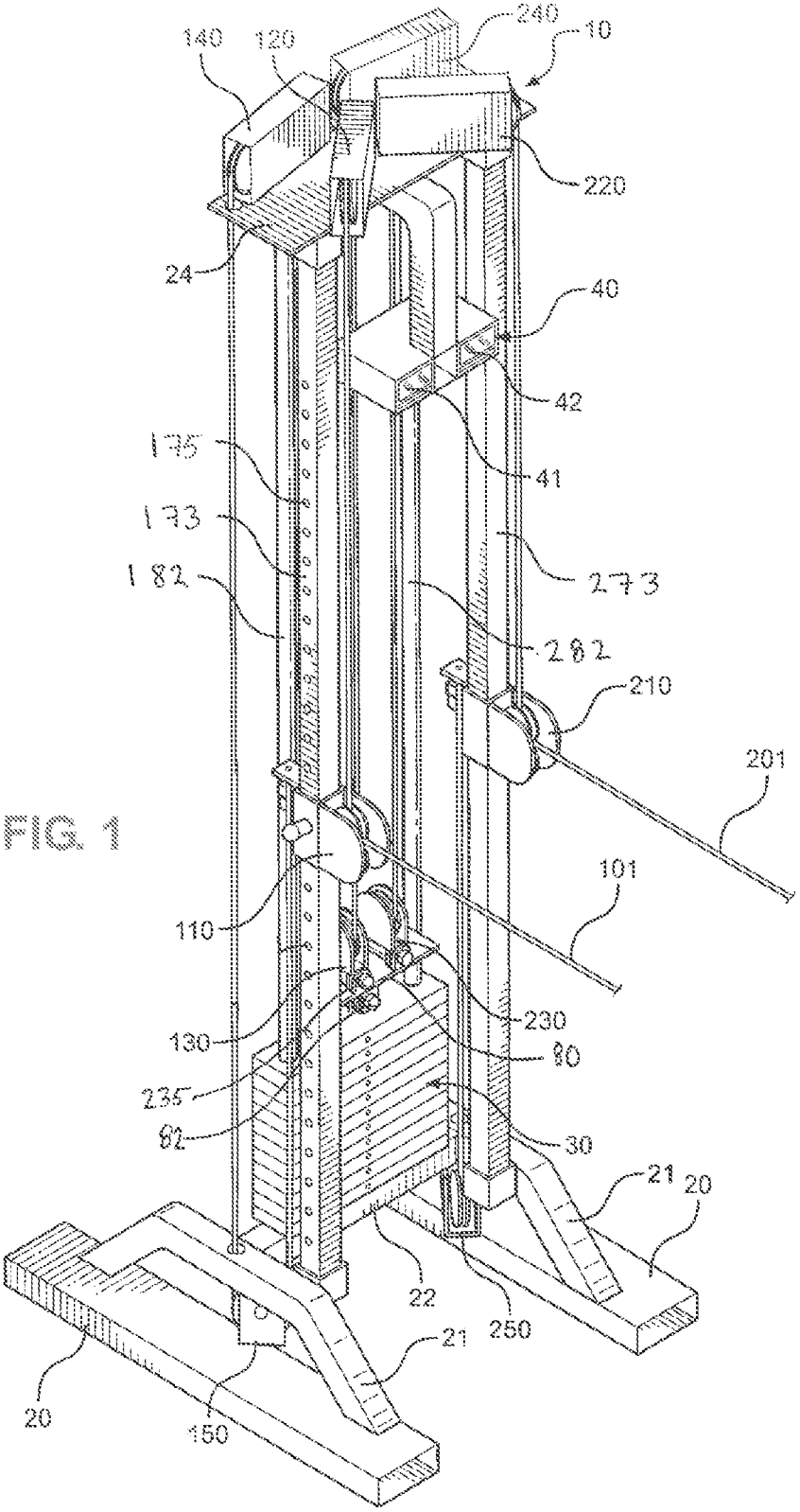
FIG. 1 depicts a side perspective view of an exercise assembly equipped with the dual balance system of the present invention.

FIG. 1 depicts a side perspective view of exercise assembly 10 equipped with the dual balance system of the present invention. In the preferred embodiment, the present invention includes a base assembly comprising lower base members 20, parallel base support members 21 and lower frame support member 22 extending between said base support members 21. Said base assembly should beneficially provide a stable and secure foundation for exercise assembly 10, particularly during exercise performance by a user.

Left vertical frame column member 173 and right vertical frame column member 273 extend upward from said base assembly. In the preferred embodiment, said vertical frame column members 173 and 273 are oriented substantially vertically and parallel to each other. Further, each of said vertical frame column members 173 and 273 can include a plurality of spaced-apart transverse bores 175 and 275, respectively; said bores are beneficially spaced apart at desired intervals. Cap member 24 is disposed on the upper ends of said substantially vertical and substantially parallel frame members 173 and 273. In addition, cap member 24 is disposed on the upper ends of substantially vertical and substantially parallel weight stack alignment rails 182 and 282.

Still referring to FIG. 1, weight stack assembly 30 is positioned within said exercise assembly 10. Although said weight stack assembly 30 can be placed in any number of different locations without departing from the scope of the present invention, in the preferred embodiment said weight stack assembly 30 is beneficially positioned on or about lower frame support member 22 and centered between parallel vertical frame column members 173 and 273. Weight stack assembly 30 comprises left weight stack alignment rail 182 and right weight stack alignment rail 282. Said weight stack alignment rails 182 and 282 are disposed on lower frame support member 22, and extend from lower frame support member 22 to cap member 24. Further, weight stack alignment rails 182 and 282 beneficially guide a plurality of weight stack plates 31 during exercise and prevent said weight stack plates 31 from falling during an exercise movement. Parallel linkage assemblies, comprising left cable 101 and right cable 201, and a plurality of pulley assemblies discussed in more detail below, is disposed on and/or around said support frame members of exercise assembly 10, and connected to weight stack assembly 30.

Weight stack assembly 30 comprises tilt platform 80 attachably connected to and relatively evenly balanced in a center position on the top of center weight stack rod 81 by means of rotatable connecting bolt 82. Rotatable connecting bolt 82 allows tilt platform 80 to substantially "tilt" or lean from side to side during exercise performance. Tilt platform 80 supports left tilt platform pulley assembly 130 and right tilt platform pulley assembly 230, wherein both tilt platform pulley assemblies 130 and 230 are mounted on rotatable mounting pins 235 that enable tilt platform pulley assemblies 130 and 230 to lean from side to side during exercise performance.

As depicted in FIG. 1, left cable 101 extends through left adjustable pulley assembly 110, over left upper front pulley assembly 120, under left tilt platform pulley assembly 130, over left upper rear pulley assembly 140 and under left lower pulley assembly 150. Although not visible in FIG. 1, left cable 101 is anchored to left adjustable pulley assembly 110.

Similarly, right cable 201 extends through right adjustable pulley assembly 210, over right upper front pulley assembly 220, under right tilt platform pulley assembly 230, over right upper rear pulley assembly 240 and under right lower pulley assembly 250. Although not visible in FIG. 1, right cable 201 is anchored to right adjustable pulley assembly 210.

Left cable 101 and right cable 201 are two separate cables that are separately connected to a single weight stack assembly 30 by way of connecting to the top of tilt platform 80. As a result, when left cable 101 and right cable 201 are separate and independent from one another, but are working together in order to lift a load, any "uneven" contribution of force exerted by the limbs will be indicated in the cable tension during exercise performance, wherein said "uneven" contribution can be viewed by the position of tilt platform 80 in relation to the top plate of weight stack assembly 30. Thus, when both limbs contribute force evenly, tilt platform 80 will be in a substantially horizontal position and relatively parallel to the top plate of weight stack assembly 30.

Figure 2:
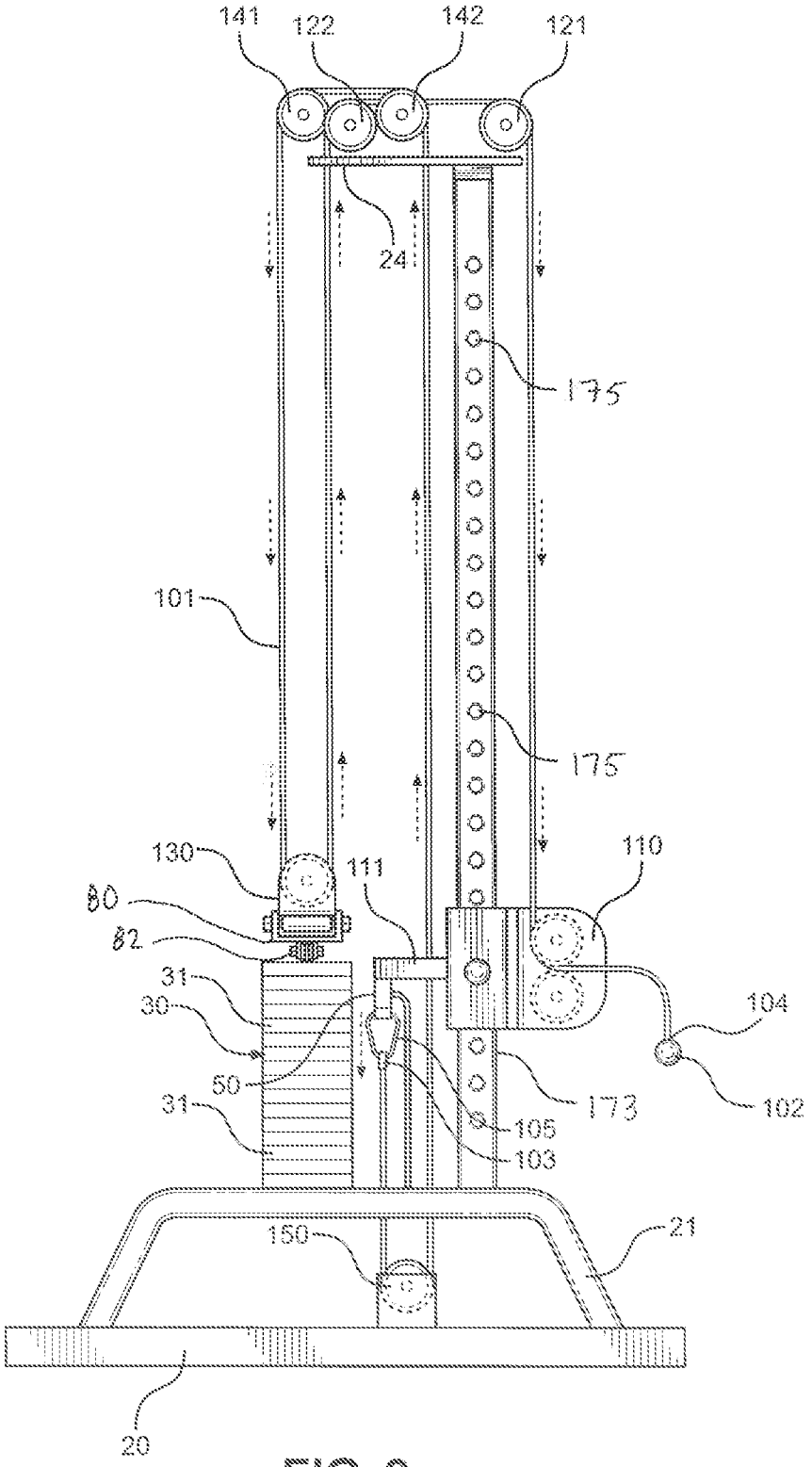
FIG. 2 depicts a first (left) side view of an exercise assembly equipped with the dual balance system of the present invention.
Figure 3:
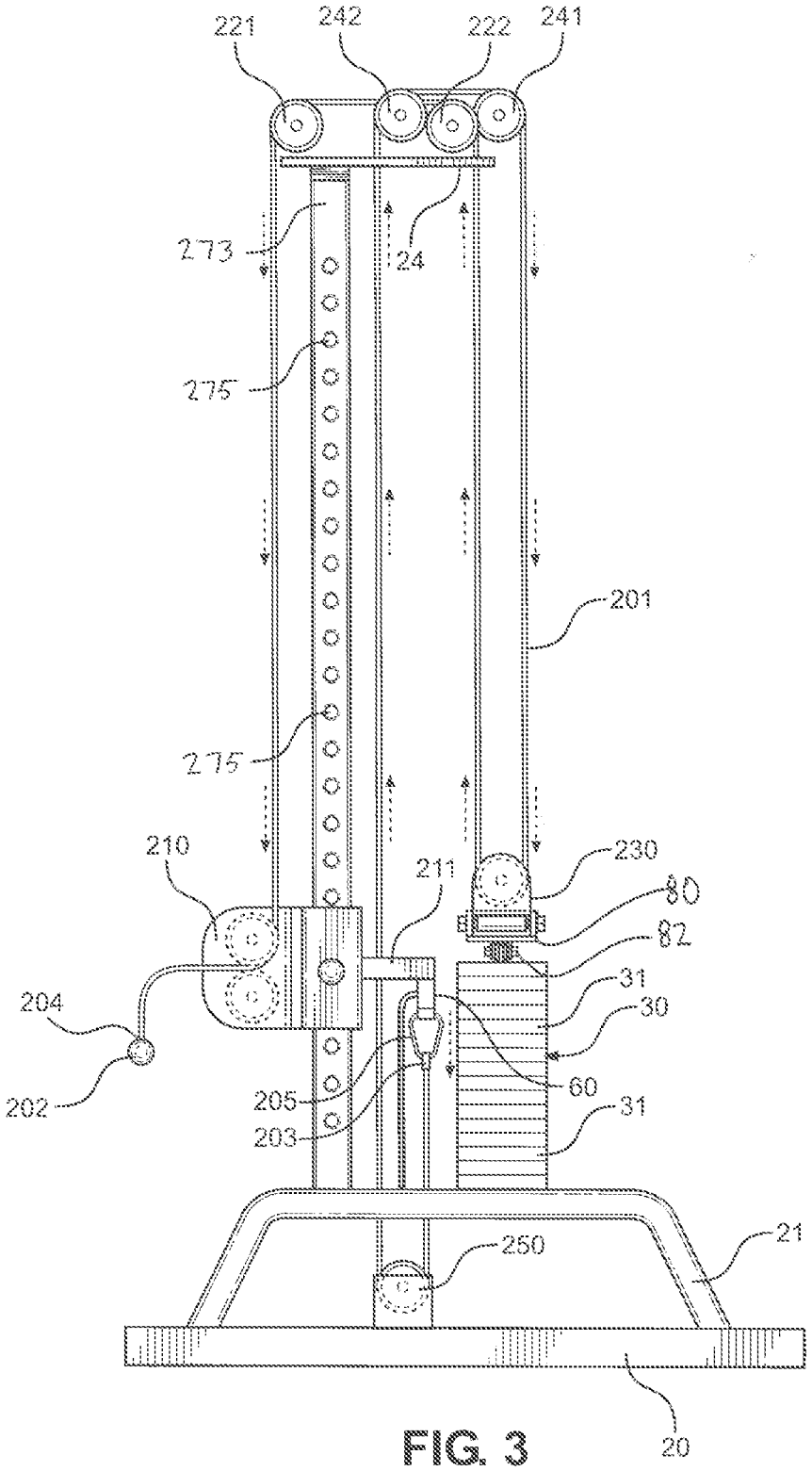
FIG. 3 depicts a second opposite (right) side view of an exercise assembly equipped with the dual balance system of the present invention.

FIG. 2 depicts a first (left) side view of an exercise assembly 10 equipped with the dual balance system of the present invention, while FIG. 3 depicts an opposite (right) side view of said exercise assembly 10 depicted in FIG. 2. A base assembly comprises lower base members 20, base support members 21 and lower frame support member 22, and provides a stable and secure foundation for exercise assembly 10.

Left vertical frame member 173 and right vertical frame member 273 extend upward from said base assembly. Said left and right vertical frame members 173 and 273 are oriented substantially vertically and include a plurality of spaced-apart transverse bores 175 and 275. Said bores 175 and 275 can be beneficially spaced apart at desired intervals. Cap member 24 is disposed on the upper ends of said substantially vertical and substantially parallel left and right frame members 173 and 273.

Weight stack assembly 30, which comprises a load for weight resistance training, is positioned within said exercise assembly 10. In the preferred embodiment, said weight stack assembly 30 comprises a plurality of stackable weight plates 31. Said plates 31 can follow a uniform weight pattern so that a user can quickly and efficiently select a desired amount of weight to be lifted by adjusting the number of weight plates 31 being used, such as by a selective weight stack pinning assembly well known to those having skill in the art.

As depicted in FIG. 2, left adjustable pulley assembly 110 is slidably disposed along a portion of the length of left vertical frame member 173. Similarly, as depicted in FIG. 3, right adjustable pulley assembly 210 is slidably disposed along a portion of the length of right vertical frame member 273. Left cable 101 and right cable 201 are disposed on and/or around said support frame members of exercise assembly 10 through a system of pulleys, and connected to tilt platform 80 and weight stack assembly 30.

Left cable 101 extends through left adjustable pulley assembly 110, over pulleys 121 and 122 of left upper front pulley assembly 120, under left tilt platform pulley assembly 130, over pulleys 141 and 142 of left upper rear pulley assembly 140 and under left lower pulley assembly 150. Distal end 103 of left cable 101 is anchored to bracket member 111 of left adjustable pulley assembly 110; the position of left adjustable pulley assembly 110 can be selectively adjusted relative to left vertical frame member 173. In the preferred embodiment, left tension meter 50 is installed between said distal end 103 of cable 101 and mounting bracket 111. Said tension meter 50 can measure the loading tension on left cable 101 as a load from weight stack 30 is lifted using left cable 101 with left limb.

As depicted in FIG. 3, right cable 201 extends through right adjustable pulley assembly 210, over pulleys 221 and 222 of right upper front pulley assembly 220, under right tilt platform pulley assembly 230, over pulleys 241 and 242 of right upper rear pulley assembly 240 and under right lower pulley assembly 250. Distal end 203 of right cable 201 is anchored to bracket member 211 of left adjustable pulley assembly 210; the position of right adjustable pulley assembly 210 can be selectively adjusted relative to right vertical frame member 273. In the preferred embodiment, right tension meter 60 is installed between said distal end 203 of cable 201 and mounting bracket 211. Said right tension meter 60 can measure the loading tension on right cable 201 as a load from weight stack 30 is lifted using right cable 201 with right limb.

Still referring to FIG. 2 and FIG. 3, the arrows depict the direction of travel when a user engages in exercise activity using exercise assembly 10. Specifically, the arrows on FIG. 2 depict the travel direction of left cable 101 when a user pulls on left handle 102 with left limb. Similarly, the arrows on FIG. 3 depict the direction of travel of right cable 201 when a user pulls on right handle 202 with right limb.

Figure 5:
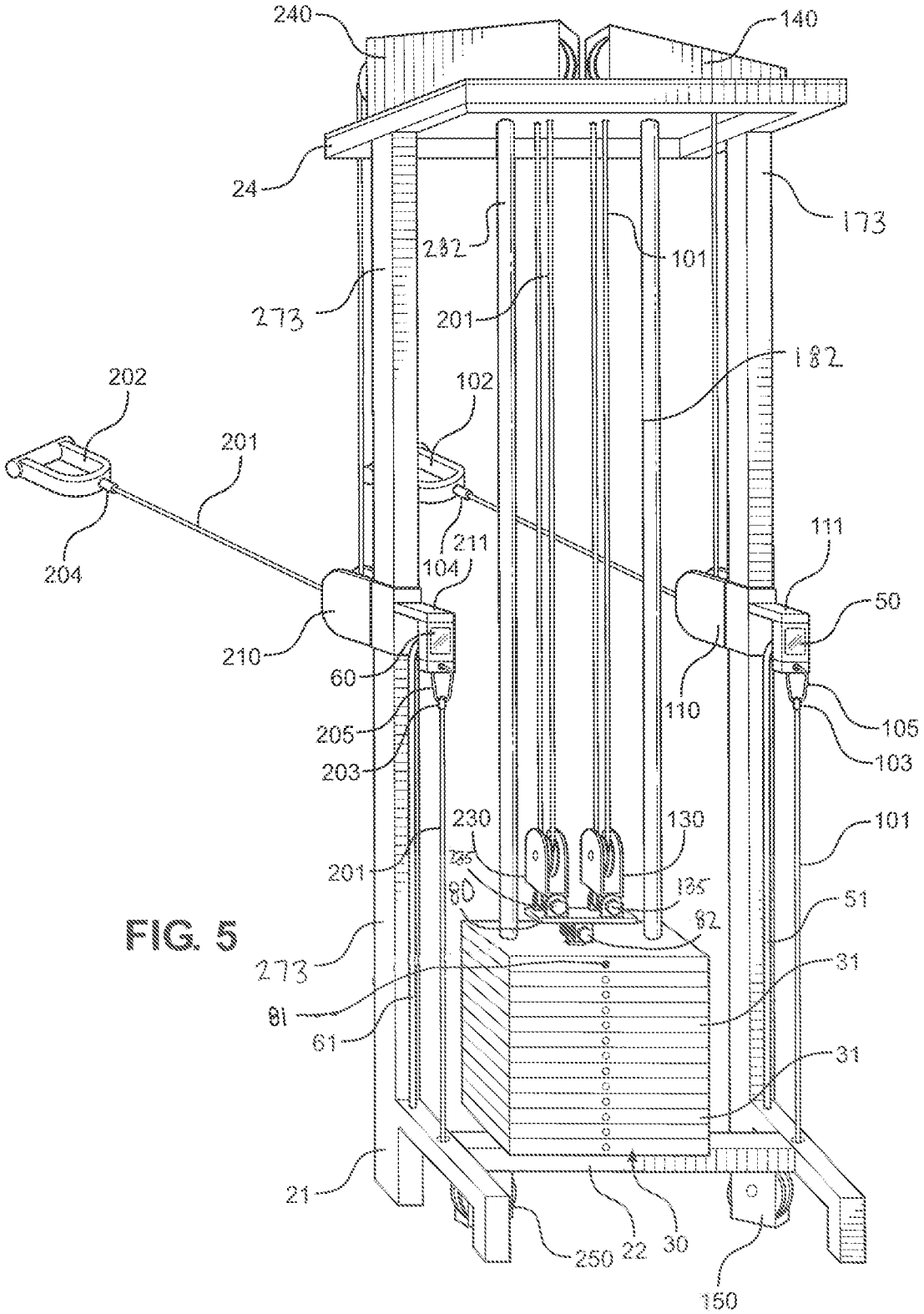
FIG. 5 depicts a rear view of an exercise assembly equipped with the dual balance system of the present invention.

FIG. 5 depicts a rear view of exercise assembly 10 equipped with the dual balance system of the present invention. A base assembly comprises a lower base assembly. Said lower base assembly depicted in FIG. 5 is slightly different than the base assembly illustrated in FIGS. 1 through 3 to illustrate that the specific design of said base assembly is generally not essential to the function of exercise assembly 10, so long, as said base assembly provides a stable and secure foundation for such exercise assembly 10. Vertical frame members 173 and 273 extend upward from said base assembly. Said vertical frame members 173 and 273 are oriented substantially vertically and parallel to each other, and include a plurality of spaced-apart transverse bores 175 and 275. Cap member 24 is disposed on the upper ends of said substantially vertical frame members 173 and 273 and on the upper ends of said substantially vertical weight stack pulley assembly 130.

Weight stack assembly 30 comprises a plurality of centrally positioned and stacked weight plates 31. Left adjustable pulley assembly 110 is slidably disposed on left vertical frame member 173, while right adjustable pulley assembly 210 is slidably disposed on right vertical frame member 273. A linkage assembly having independently functioning left cable 101 and right cable 201 is disposed on and around said support frame members of exercise assembly 10 (including, without limitation, over left upper rear pulley assembly 140 and right upper rear pulley assembly 240), and connected to tilt platform 80. A left handle member 102 is attached to proximate end 104 of left cable 101, while right handle member 202 is attached to proximate end 204 of right cable 201.

Distal end 103 of left cable 101 is anchored to bracket member 111 of left adjustable pulley assembly 110. In the preferred embodiment, left tension meter 50 is installed between said distal end 103 of cable 101 and mounting bracket 111. Said left tension meter 50 can measure the loading tension on left cable 101 as weight from weight stack 30 is lifted using left cable 101. Although different means of attachment can be envisioned, said distal end 103 of left cable 101 can be attached to left tension meter 50 using link member 105.

Distal end 203 of right cable 201 is anchored to bracket member 211 of right adjustable pulley assembly 210. In the preferred embodiment, right tension meter 60 is installed between said distal end 203 of cable 201 and mounting bracket 211. Said right tension meter 60 can measure the loading tension on right cable 201 as weight from weight stack 30 is lifted using right cable 201. Although different means of attachment can be envisioned, said distal end 203 of cable 201 can be attached to right tension meter 60 using link member 205.

Figure 4:
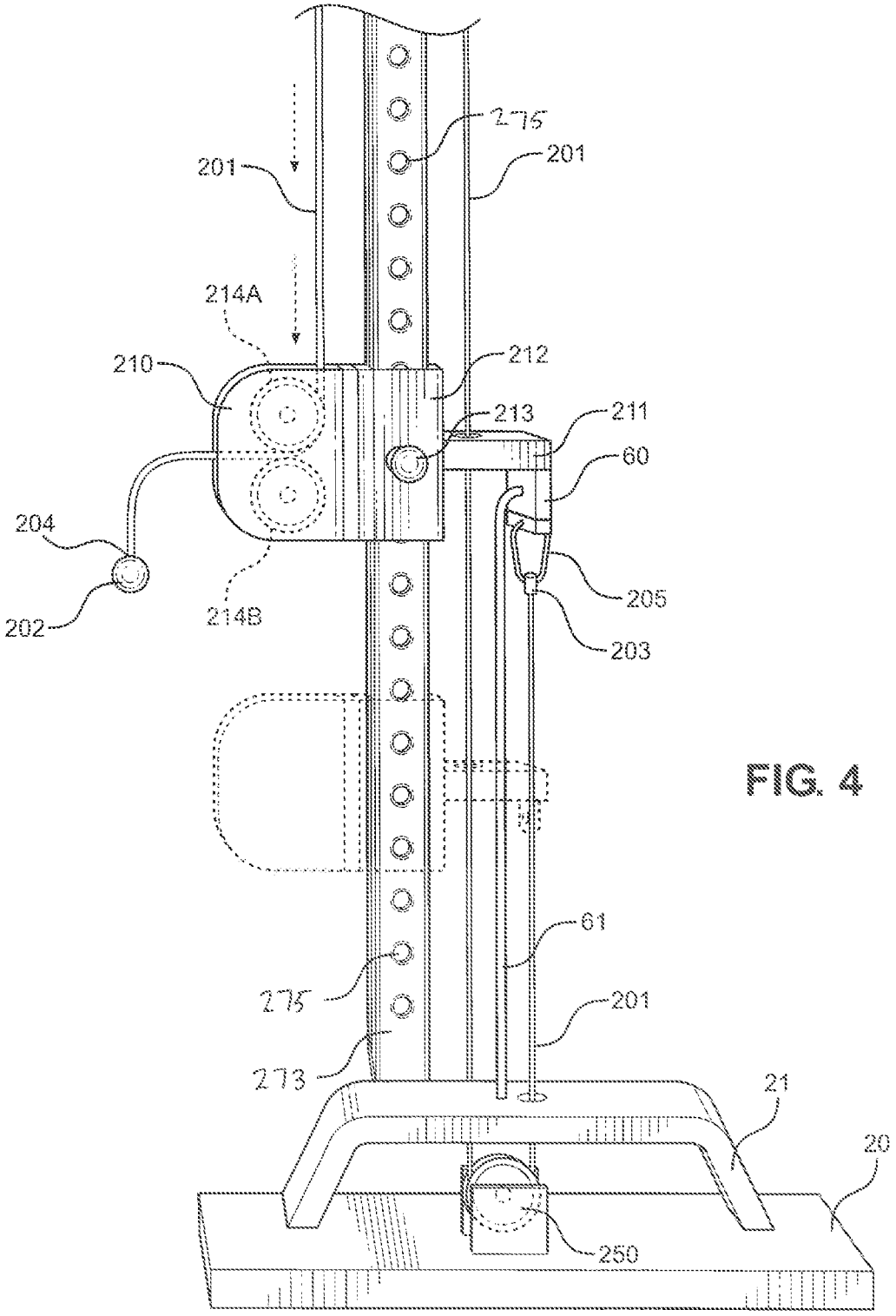
FIG. 4 depicts a detailed side view of a portion of a vertical frame column member and right adjustable pulley and linkage assembly of the present invention.

FIG. 4 depicts a detailed side view of a portion of a right vertical frame column member 273 and right adjustable pulley assembly 210 and linkage assembly of the present invention. Right cable 201, having handle member 202 attached at proximate end 204, extends through pulleys 214 of right adjustable pulley assembly 210. Right adjustable pulley assembly 210 has housing section 212 slidably disposed on right vertical column member 273. Said housing section 212 can be selectively secured in place using adjustment pin 213, which can be received within transverse bores 275. (Although not visible in FIG. 4, as can be observed from FIG. 3, said right cable 201 extends over pulleys 221 and 222 of right upper front pulley assembly 220, under right tilt platform pulley assembly 230, over pulleys 241 and 242 of right upper rear pulley assembly 240 and under right lower pulley assembly 250).

Distal end 203 of right cable 201 is anchored to bracket member 211 of right adjustable pulley assembly 210 which, in turn, can be adjustably positioned relative to right vertical frame member 273. In the preferred embodiment, right tension meter 60 is installed between said distal end 203 of cable 201 and mounting bracket 211. Distal end 203 of cable 201 is attached to right tension meter 60 using link member 205.

Said right tension meter 60 can measure the loading tension on right cable 201 as a load (such as all or part of weight stack 30) is lifted using right cable 201. As depicted in FIG. 4, wire 61 is connected to said tension meter 60 to transmit data measured by said tension meter 60. In the preferred embodiment, said wire 61 extends through tubular frame members of exercise assembly 10 to an electronic biofeedback display that is visible or otherwise discernable to a user. For example, referring to FIG. 1, said wire 61 can extend to electronic biofeedback display 40, and right side display 42 in particular, to visually display data measured by said tension meter 60. Such measured force is relayed to a digital display 40 that displays the amount of weight being lifted by each individual limb (via left display 41 and right display 42) during bilateral exercise.

Referring back to FIG. 5, it is to be observed that a similar arrangement is provided for left cable 101. Left tension meter 50 can measure the loading tension on left cable 101 as a load (such as all or part of weight stack 30) is lifted using left cable 101. As depicted in FIG. 5, wire 51 is connected to said left tension meter 50 to transmit data measured by said left tension meter 50. In the preferred embodiment, said wire 51 extends through tubular frame members of exercise assembly 10 to a biofeedback display that is visible or otherwise discernable to a user. For example, referring back to FIG. 1, said wire 51 can extend to electronic biofeedback display 40, and left side display 41 in particular, to visually display data measured by said left tension meter 50.

In lieu of wires 51 and 61, it is to be observed that other means of transmitting data measured by tension meters 50 and 60 to electronic biofeedback display 40 can be used without departing from the scope of the present invention. For example, a wireless system using radio frequency transmission or other known data transmission means can be used to transmit such data. Further, it is to be observed that other display or signaling means could be used either in place of, or in tandem with, electronic biofeedback display 40. For example, an audible alarm can be provided to sound when certain predetermined parameters are measured by tension meters 50 and/or 60.

The biofeedback system of the present invention (including, without limitation, electronic display device 40 in FIG. 1 and tilt platform 80) enables a user to receive real-time visual feedback during exercise performance. Specifically, said biofeedback system of the present invention provides data to a user to indicate how much each limb is contributing to the overall work effort during bilateral exercise. Further, such biofeedback system of the present invention allows a user to "even out" strength imbalance between the two limbs, and train a user to "lead with the weak side" in order to build strength in said weak side, while decreasing the force output of the dominant side so that said dominant side does not overpower said weak side during bilateral exercise.

Figure 6:
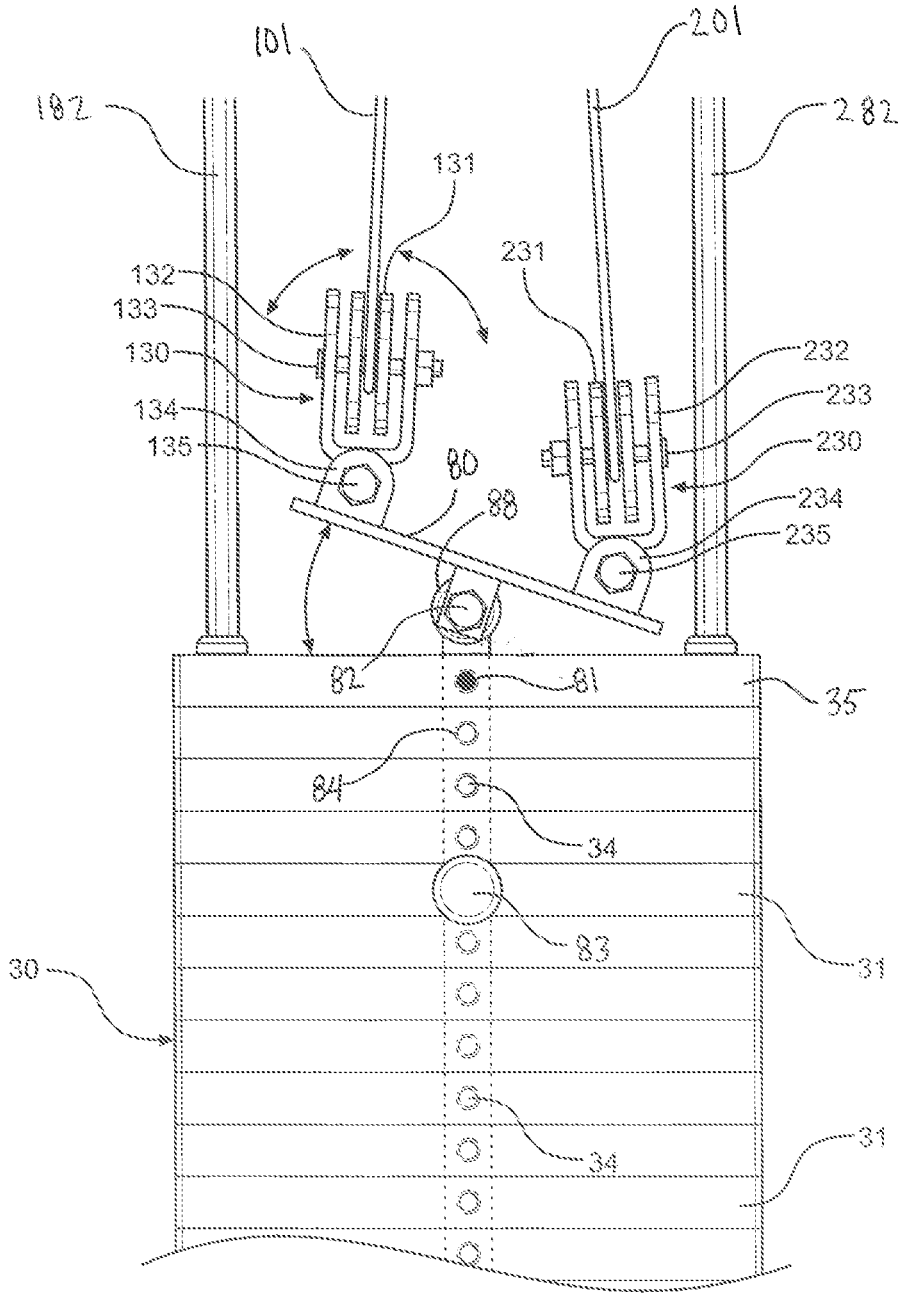
FIG. 6 depicts a front view of a weight stack with pulley assemblies and a tilt platform in accordance with the dual balance system of the present invention.

FIG. 6 depicts a front view of weight stack 30 with tilt platform 80 attached to a weight stack center rod 81 via a connecting rotatable mounting pin 82. Further, weight stack 30 comprises left and right tilt platform pulley assemblies 130 and 230 attached to tilt platform 80 in accordance with the dual balance system of the present invention. In the preferred embodiment, weight stack 30 comprises a plurality of stackable weight plates 31 that permit selective adjustment in the amount of weight load to be lifted. Although different means can be contemplated, said stackable weight plates 31 have transverse bores 34 to accept a pin 83 or other similar means to permit such adjustable weight selection.

Weight stack assembly 30 comprises top plate 35 that is attachably connected to weight stack center rod 81. Said center rod 81 has a plurality of transverse bores 84 that align with weight stack transverse bores 34 in order to accept a pin 83, or any other similar means that allows for an adjustable weight stack selection.

In the preferred embodiment, tilt platform 80 is mounted to the weight stack center rod 81 and the top weight stack pick-up plate 35 by means of a rotatable mounting pin 82. Tilt platform 80 comprises clevis mounting bracket 88 having rotatable mounting pin 82. Further, tilt platform 80 supports left tilt platform pulley assembly 130 and right tilt platform pulley assembly 230.

In addition, in the preferred embodiment, left tilt platform pulley assembly 130 comprises pulley wheel 131 rotatably disposed within pulley housing 132; said pulley wheel 131 is rotatable about pulley axle 133. Pulley housing 132 is mounted to tilt platform 80 using clevis mounting bracket 134 having rotatable mounting pin 135. Mounting pin 135 is rotatable within said clevis bracket 134. Similarly, right tilt platform pulley assembly 230 comprises pulley wheel 231 rotatably disposed within pulley housing 232; said pulley wheel 231 is rotatable about pulley axle 233. Pulley housing 232 is mounted to tilt platform 80 using clevis mounting bracket 234 having rotatable mounting pin 235. Mounting pin 235 is rotatable within said clevis bracket 234.

Left cable 101 is disposed around left tilt platform pulley wheel 131, while right cable 201 is disposed around right tilt platform pulley wheel 231. It is to be observed that when left cable 101 is taut (such as when said cable is under tension), left tilt platform pulley assembly 130 is in a substantially upright position. In other words, left pulley member 131 is oriented in a substantially vertical plane. Similarly, when right cable 201 is taut (such as when said cable is under tension), right weight stack pulley assembly 230 is in a substantially upright position. The amount of force exerted by each limb on its respective cable (i.e., left cable 101 for left limb and right cable 201 for right limb) will determine the position of tilt platform 80 in relation to top plate 35 of weight stack assembly 30. In the start position of the exercise movement, it is necessary to have a sufficient amount of force exerted by each limb on their respective cables in order to place the pulley wheels 131 and 231 in a substantially vertical plane, thus placing tilt platform 80 in a relatively horizontal position.

Further, it is to be observed that tilt platform pulley housings 132 and 232 can rotate about clevis pivot pins 135 and 235, respectively, allowing such mounting means to act as swivel bushings. This rotational ability allows the pulley wheels 131 and 231 to remain substantially vertical during exercise performance, as long as there is a sufficient initial force output along the cables by the limbs.

As such, if a greater upward force is acting upon left tilt platform housing 132, the left side of tilt platform 80 will "raise" in a relatively upward direction and right side of tilt platform 80 will "drop" in a relatively downward direction. This tilt indicates that a left limb is exerting more force than a right limb. Thus, a user, by observing the position of tilt platform 80 during exercise performance, can correct the force output of the limbs in order to place tilt platform 80 in a desired substantially horizontal position. This visual observation by the user in "real time" during exercise performance can train the user's brain and nervous system by means of a visual biofeedback system in order to correct strength imbalance between the left and the right limbs. As a result, over a period of time, the "weak" side can become equal in strength to the "dominant" (strong) side. Both sides will then be able to contribute equally and evenly to the overall strength output during such bilateral exercise performance.

As noted herein, left and right cable and pulley linkage assemblies of exercise assembly 10 are independent from one another; that is, such cables and pulleys split loading from weight stack 30 into two equal halves, with fifty (50%) percent resistance for each side (left and right). As such, said load from weight stack 30 is evenly split between a user's left and right limbs during bilateral exercise performance.

Because such parallel left and right cable and pulley linkage assemblies of the present invention operate independently from each other, a user immediately receives an indication if one limb (left or right) is contributing more effort than the other limb during bilateral exercise. Such indication includes, without limitation, a cable on the "weaker" side becoming slack which, in turn, results in tilt platform 80 "tilting" to the weaker side. The user is able to use this visual cue to exert more force with the weaker limb and less force with the stronger limb in order for tilt platform 80 to balance along the central rod 81 in a relatively horizontal position, thereby indicating equal contributions from both limbs.

Figure 7:
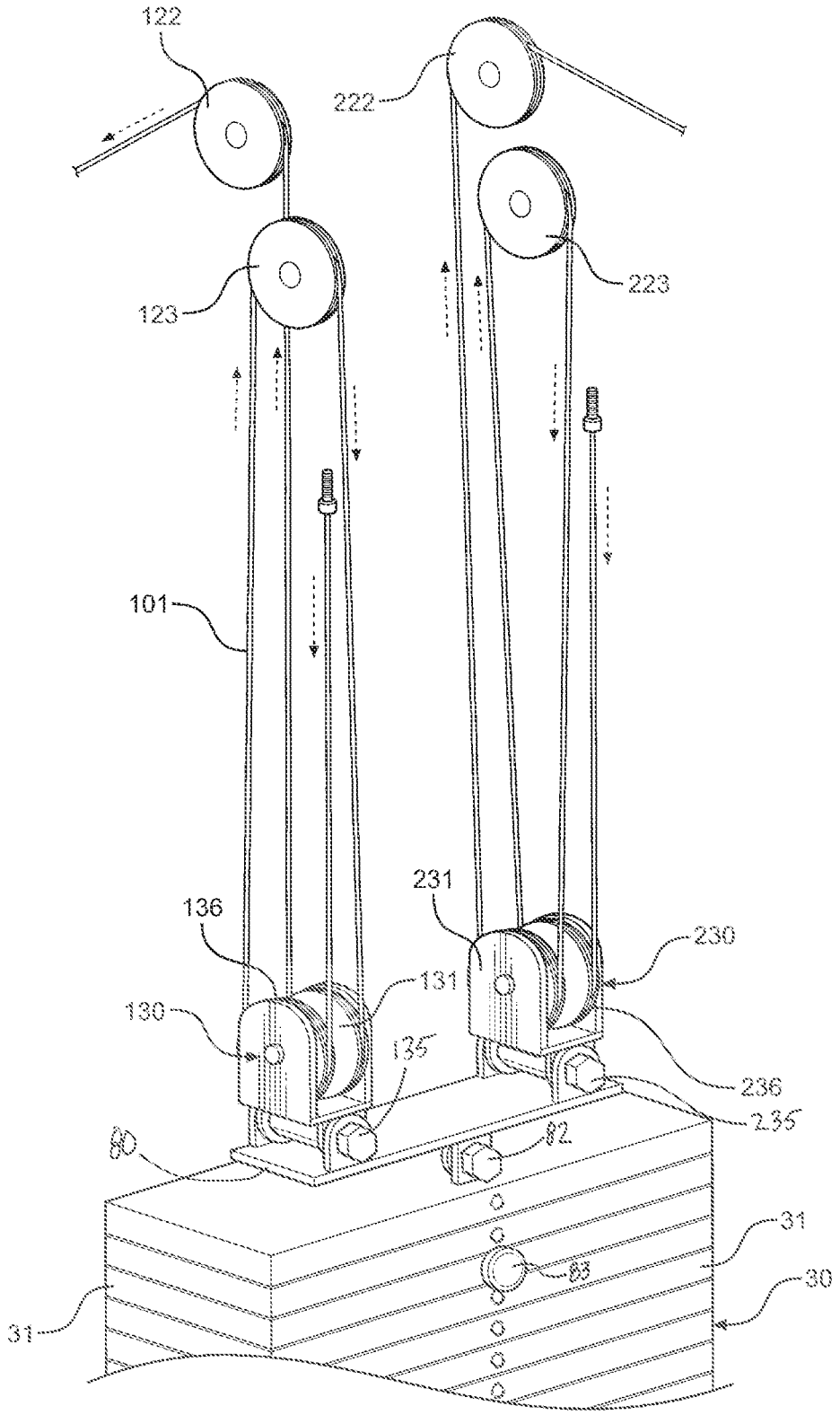
FIG. 7 depicts an alternative embodiment cable, pulley assemblies and tilt platform of the present invention.

FIG. 7 depicts an alternative embodiment cable and pulley linkage assemblies of the present invention. In the alternative embodiment of the present invention depicted in FIG. 7, left tilt platform pulley assembly 130 can include an additional pulley wheel 136, while left upper front pulley assembly 120 can include additional pulley wheel 123. Similarly, right tilt platform pulley assembly 230 can include an additional pulley wheel 236, while right upper front pulley assembly 220 can include additional pulley wheel 223. Said additional pulley wheels allow for exercise assembly 10 of the present invention to better accommodate high speed bilateral resistance training. In the preferred embodiment, said left and right tilt platform pulley assemblies 130 and 230 are symmetrically situated relative to tilt platform 80—that is, said left and right tilt platform pulley assemblies are the same distance from the center (and outer sides) of said tilt platform 80.

The dual balance exercise assembly of the present invention permits a user to work both sides of the body in a coordinated, dynamic manner using bilateral weight training. In addition to other benefits, such balanced training can also significantly improve physical therapy outcomes. By challenging a user's nervous system, muscles and connective tissues work together to achieve balanced effort. As a result, a user's body learns how to strengthen the weaker side by integrating and strengthening the mind-body connection.

Although the exercise assembly of the present invention is described herein primarily in connection with lifting of a load, such as weight stack 30, it is to be observed that the present invention can be beneficially used with virtually any resistance means. In addition to a weight load, such resistance can also be provided by other means including, without limitation, pneumatic systems. Additionally, the present invention can also be used on exercise assemblies using body weight as a source of resistance; by way of illustration, but not limitation, such assemblies can include exercise bikes, elliptical training machines, treadmills, rowers, and physical therapy machines.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An exercise assembly comprising:

a) a frame;

b) a single resistance source;

c) a tilt platform pivotally attached to said single resistance source;

d) a first pulley connected to said frame;

e) a second pulley connected to said tilt platform;

f) a first cable disposed around said first and second pulleys and connected to said frame;

g) a third pulley connected to said frame;

h) a fourth pulley connected to said tilt platform; and i) a second cable disposed around said third and fourth pulleys and connected to said frame.

2. The exercise assembly of claim 1, wherein a first tension force is applied to said first cable by a first limb, a second tension force is applied to said second cable by a second limb, and said first and second tension forces are independently imparted on said resistance source.

3. The exercise assembly of claim 2, wherein said tilt platform is adapted to visually display relative contributions of said first limb and said second limb simultaneously applying force on said single resistance source.

4. The exercise assembly of claim 1, wherein said single resistance source comprises a load.

5. The exercise assembly of claim 4, wherein said load comprises a plurality of vertically stackable plates.

6. An exercise assembly comprising:

a) a frame;

b) a single load;

c) a tilt platform pivotally attached to said single load;

d) a first linkage assembly comprising:

i) a first pulley connected to said frame;

ii) a second pulley connected to said tilt platform;

e) a first cable having a distal end and a proximate end, wherein said distal end is anchored to said frame, and said first cable is disposed around said first and second pulleys of said first linkage assembly;

f) a second linkage assembly comprising:

i) a third pulley connected to said frame;

ii) a fourth pulley connected to said tilt platform; and g) a second cable having a distal end and a proximate end, wherein said distal end is anchored to said frame, and said second cable is disposed around said third and fourth pulleys of said second linkage assembly.

7. The exercise assembly of claim 6, wherein said tilt platform is adapted to visually display relative contributions of a first limb applying a first tension force to said first cable and a second limb simultaneously applying a second tension force to said second cable.

8. The exercise assembly of claim 7, wherein said single load comprises a weight stack.

9. The exercise assembly of claim 8, wherein said weight stack comprises a plurality of vertically stackable plates.

10. The exercise assembly of claim 9, further comprising:

a) a first tension meter disposed between said proximate and distal ends of said first cable, wherein said first tension meter is adapted to measure said first tension force applied to said first cable; and, b) a second tension meter disposed between said proximate and distal ends of said second cable, wherein said second tension meter is adapted to measure said second tension force applied to said second cable.

11. A method for determining relative contributions of a first limb and a second limb simultaneously imparting lifting force on a single resistance source comprising:

a) pulling on a proximate end of a first cable of an exercise assembly with said first limb, wherein said exercise assembly comprises:

i) a frame, wherein said single resistance source is disposed on said frame;

ii) a tilt platform pivotally attached to said single resistance source;

iii) a first pulley connected to said frame;

iv) a second pulley connected to said tilt platform, wherein said first cable has said proximate end and a distal end, said first cable is disposed around said first and second pulleys, and said distal end of said first cable is connected to said frame;

v) a third pulley connected to said frame;

vi) a fourth pulley connected to said tilt platform; and vii) a second cable, wherein said second cable has said proximate end and a distal end, said second cable is disposed around said third and fourth pulleys, and said distal end of said second cable is connected to said frame;

b) simultaneously pulling on a proximate end of said second cable with said second limb; and c) observing relative contributions of said first and second limbs in lifting said single resistance source based on the amount of tilt of said tilt platform from a horizontal orientation.

12. The method of claim 11, wherein said single resistance source comprises a load.

13. The method of claim 12, wherein said load comprises a plurality of vertically stackable plates.

14. The method of claim 11, further comprising the step of adjusting the amount of force applied by said first and second limbs in order to maintain said tilt platform in a substantially horizontal orientation.

* * * * *